United States Patent [19]

Young

[11] 4,133,590

[45] Jan. 9, 1979

[54] BOUND VOLUME SUITABLE FOR FILING CABINET STORAGE

[75] Inventor: Raymond R. Young, Glenview, Ill.

[73] Assignee: Wilson Jones Company, Chicago, Ill.

[21] Appl. No.: 672,121

[22] Filed: Mar. 31, 1976

[51] Int. Cl.[2] ..... A47B 63/00

[52] U.S. Cl. ..... 312/183; 312/184; 281/21 R; 402/4

[58] Field of Search ..... 312/184; 281/21 R, 45, 281/47; 402/4

[56] References Cited

U.S. PATENT DOCUMENTS

| | | | |
|---|---|---|---|
| 394,189 | 12/1888 | Kinnard | 281/45 |
| 1,083,539 | 1/1914 | Haush | 281/45 |
| 1,217,243 | 2/1917 | Tucker et al. | 312/184 |
| 1,254,635 | 1/1918 | Applegate | 281/47 |
| 3,284,102 | 11/1966 | Sack | 281/21 R |
| 3,572,867 | 3/1971 | Cooper | 312/184 |
| 3,684,340 | 8/1972 | Kirkorian | 312/184 |
| 3,811,998 | 5/1974 | James | 281/21 R |
| 3,862,687 | 1/1975 | Pirman | 312/184 |
| 3,923,353 | 12/1975 | Elias et al. | 312/184 |

FOREIGN PATENT DOCUMENTS

| | | | |
|---|---|---|---|
| 1025546 | 4/1953 | France | 402/4 |
| 1342239 | 9/1963 | France | 312/184 |
| 199973 | 9/1938 | Switzerland | 312/184 |
| 447111 | 11/1965 | Switzerland | 281/47 |
| 412799 | 5/1966 | Switzerland | 312/184 |
| 773007 | 4/1957 | United Kingdom | 402/7 |
| 848124 | 9/1960 | United Kingdom | 312/184 |
| 1020772 | 2/1966 | United Kingdom | 312/184 |

*Primary Examiner*—Victor N. Sakran

*Attorney, Agent, or Firm*—Pennie & Edmonds

[57] ABSTRACT

A bound volume and a method of making the same is disclosed. The bound volume incorporates a bar extending along the length of the spine of the volume and secured to the spine. A pair of end caps are provided which allow the bound volume to be hung in a convenient manner. The end caps engage the ends of the bar, which extend from the bound volume, and may be removed to allow convenient use. The end caps include surfaces for either slidably engaging rails or hookingly engaging bars.

4 Claims, 8 Drawing Figures

BOUND VOLUME SUITABLE FOR FILING CABINET STORAGE

BACKGROUND OF THE INVENTION

The increasingly widespread employment of data processing and record keeping equipment has given rise to a significant need for convenient methods of keeping relatively large quantities of otherwise disorderly printed material in convenient form. The present invention has for its object the provision of a convenient device for binding together a plurality of sheets of paper into book form, while allowing the bound books to be conveniently handled and stored. The instant invention is particularly useful because it makes possible an efficient techinque for binding, use and storage of output printed data from data processing equipment.

In the past, the output sheets from data processing equipment, which are typically in the form of a series of connected sheets folded alternatively in different directions, were stored by simply being stacked, or kept in drawers, boxes or the like. If one decided to inspect the sheets one would have to go to the trouble of retrieving them, perhaps from an inconvenient place, such as the bottom of a box. In inspecting the sheets, care had to be taken to prevent them from coming apart. Moreover, going through the sheets was difficult because of their relatively loose format.

In accordance with the present invention, the aforementioned disadvantages of the prior art are alleviated. The invention is applicable to a series of alternatively folded sheets, such as the output of conventional data processing equipment or separate sheets. They are maintained in a bound form which permits easy inspection and efficient retrieval. Moreover, the bound sheets are easily storable and retrievable.

SUMMARY OF THE INVENTION

In accordance with the present invention, a plurality of sheets are bound into a book by disposing the sheets adjacent each other in positions in which they each have an edge in alignment with corresponding edges of the other sheets. These edges thus form a substantially continuous surface. A bar is disposed within the thus formed stack of sheets at a point within the stack in a position in which an edge of the bar is substantially flush with the substantially continuous surface formed by the edges of the sheets. The edge of the bar thus becomes part of the continuous surface. The edges of the sheets and the edge of the bar are then bound to each other to form the book. Typically, this may be done by depositing an adhesive over the continuous surface. The bound volume is provided with a pair of caps which mate with and are secured to the two ends of the bar.

The bound volumes with the caps secured to the ends of the bar are suitable for storage in either a side-loading or top-loading data processing retention or housing device such as those illustrated in U.S. Pat. Nos. 3,880,095 and 3,913,995. This is possible because the caps are provided with structure for both engaging and being slidably advanced into a mating member as well as structure for hookingly engaging a support bar in a top-loading cabinet.

Each of the caps comprises a body defining a channel which extends in the same direction as the bar and is adapted to engage the end of the bar. An engagement arm is secured to the body and extends in a first direction along the length of the bar and is positioned, configured and dimensioned to engage the adhesive when the end of the bar is inserted into the channel. A depression extends in a direction opposite the direction in which the engagement arm extends and is configured, dimensioned and positioned to engage a longitudinal support which is placed transverse to the direction in which the bar extends. Slidable engagement means secured to the main body of the cap and extending along the direction of the bar are provided to allow the caps on the ends of the bar to be placed into slidable engagement with the mating member when the caps are advanced into the mating member by movement in the direction in which said bar extends.

DETAILED DESCRIPTION OF THE PREFERRED EMBODIMENT

Figure 1:
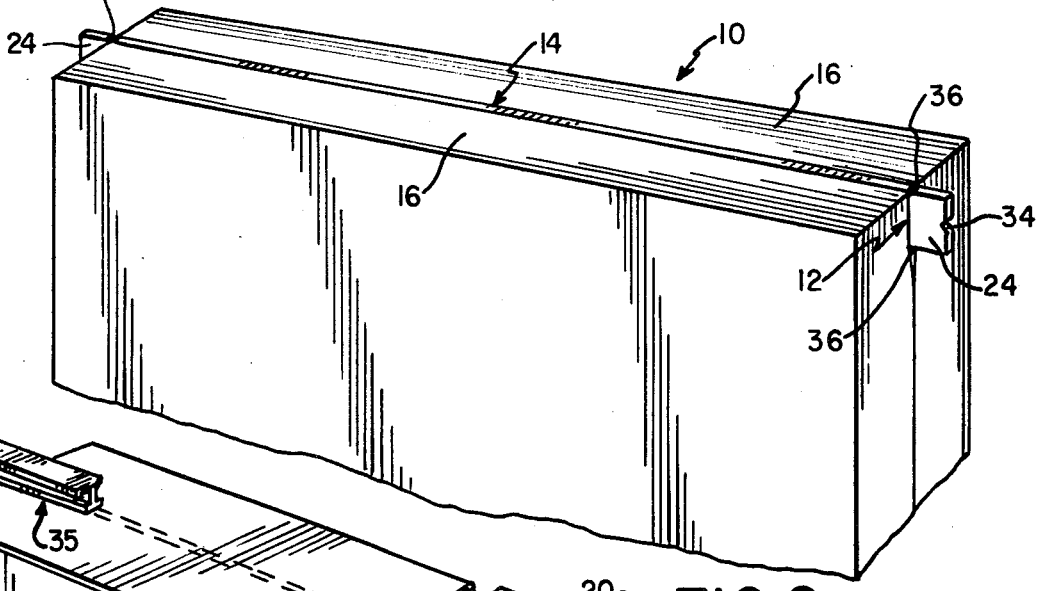
FIG. 1 is a perspective view of a stack of sheets to be bound showing the insertion of the bar prior to the application of adhesive.

Referring to FIG. 1, when it is desired to put a stack of sheets 10 into a bound suspendable format, one separates the stack at a point 12 into two portions and inserts an elongated rectangular bar 14 between the two portions. Preferrably, this bar is made of plastic and has an edge surface that is aligned to be flush with the edge surfaces 16 of the stack of sheets 10 to be bound. The stack of sheets 10 and the bar 14 thus assume the positions shown in FIG. 1, with their edges forming a substantially continuous surface. The sheets are then bound using a machine or any other suitable means to apply an adhesive to the edge surface of the bar and the edge surfaces 16 of the stacks, thereby putting the stack in book form, allowing most convenient inspection.

Figure 2:
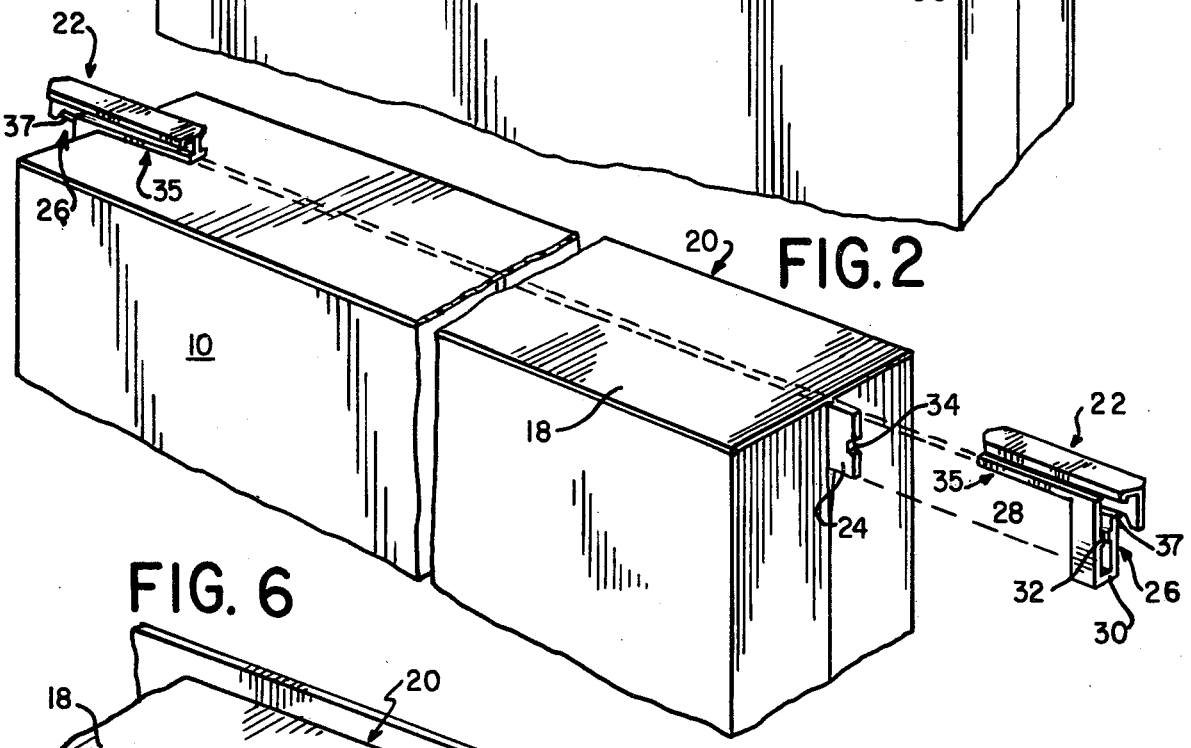
FIG. 2 is a perspective view of the stack of sheets shown in FIG. 1 after the application of adhesive and showing one of the caps in position in engagement with one end of the bar and the other in exploded perspective with respect to the other end of the bar.
Figure 3:
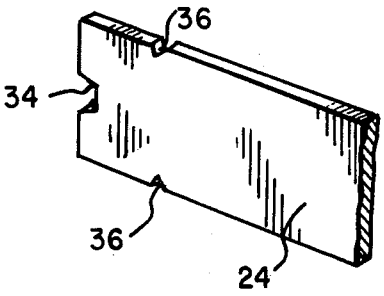
FIG. 3 is a perspective in detail showing the end of the bar.
Figure 4:
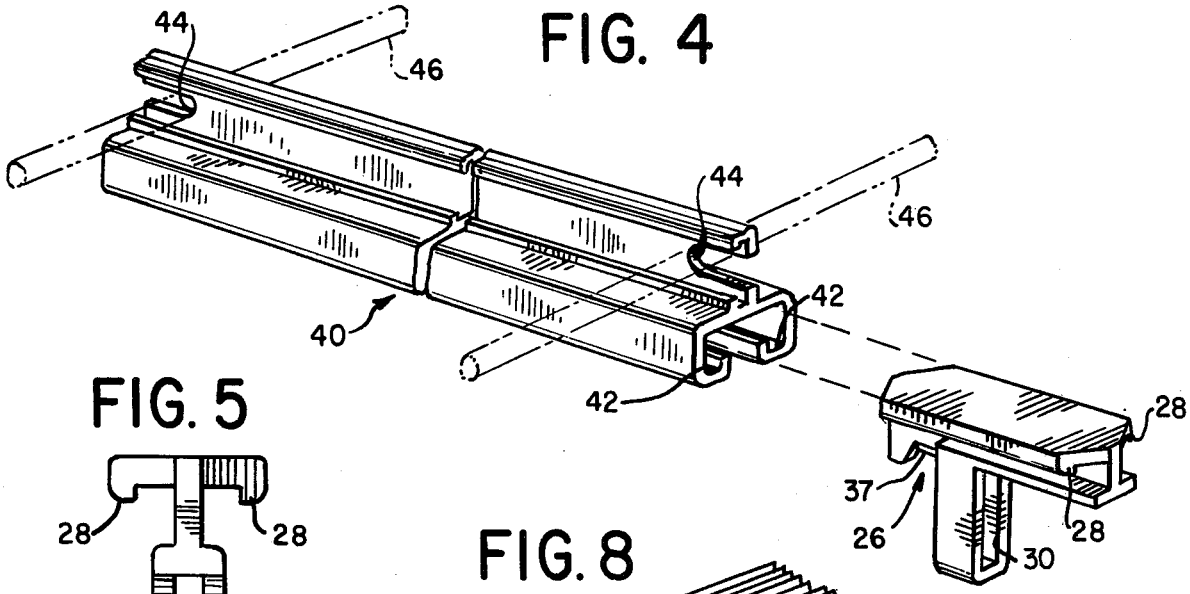
FIG. 4 is an exploded perspective illustrating the engagement of a cap constructed in accordance with the present invention with a mating slidable member.
Figure 5:
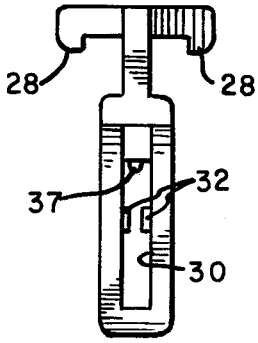
FIG. 5 is an end plan view of the inventive cap.

Such an arrangement of sheets 10, bound to bar 14 by an adhesive 18 and forming a bound volume 20 is illustrated in FIG. 2. When it is desired to hang bound volume 20, end caps 22 are fitted onto the ends 24 of bar 14. The end cap of the present invention is illustrated in FIGS. 2, 4 and 5. Each end cap includes a bar engaging depression 26 and a pair of channel engaging rails 28. The caps are fitted onto ends 24 by passing the ends through a guideway 30 inside caps 22. At the end of the guideway a pair of studs 32 are provided. Studs 32 mate with a slot 34 on the end of bar 14, as illustrated in FIG. 3. An engagement arm 35 is configured, dimensioned and positioned to frictionally engage the adhesive 18. A notch 36 is provided on bar 14 for the purpose of aligning the bar in the proper position prior to the application of adhesive 18. A spherical radius 37 is provided to assure a tight fit with the bar.

Figure 6:
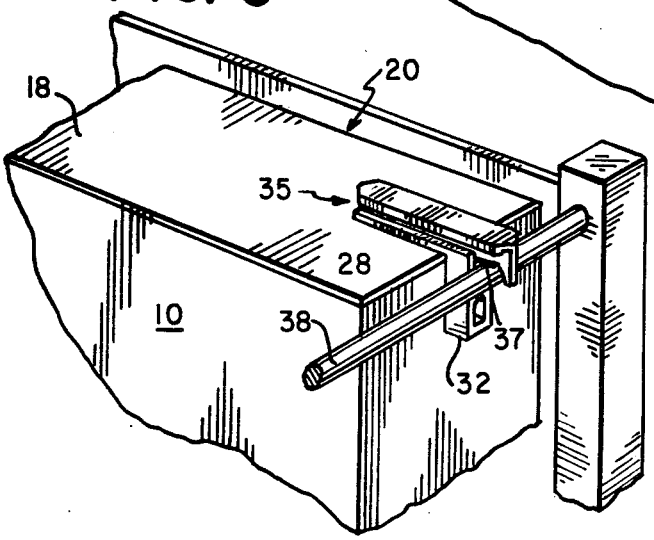
FIG. 6 is a perspective view showing the loading of a volume bound in accordance with the present invention into a top-loading cabinet.

Hanging is achieved in a top-loading data processing retention device by simply placing the bound volume 20 with its caps 22, down into the file as illustrated in FIG. 6. In such a file the bound volume 20 is supported directly by caps 22 whose bar engaging depression 26 hookingly engages a bar 38 inside the file. If on the other hand it is desired to place the bound volume 20 into a side-loading data processing retention device, the side-loading file is provided with a channel member 40 (FIG. 4) which includes a pair of channels 42 which mate with rails 28. Channel member 40 is in turn provided with bar engaging depressions 44 which mate with a pair of bars 46 in the side-loading file.

It is noted that when the binder is removed from storage and put into use, caps 22 may be removed to make handling more convenient and to reduce the combined size of the binder and suspension device. It is also noted that alternatively sheets 10 may be bound without a bar, such as bar 14, and a thin bar may be inserted into the bound sheets after binding. However, the preferred embodiment of the present invention contemplates the binding of a bar into the sheets, insofar as this makes it unlikely that the bar will fall from the bound volume.

The inventive device thus provides a convenient method for both storing and improving the accessibility of printed material such as the leaves of a conventional book, computer printout sheets or any other printed material in sheet form. The invention may be equally well employed to bind a plurality of separate sheets, or a continuous series of sheets such as that illustrated in FIG. 8, which are connected to each other and folded with folds in alternate directions.

Figure 8:
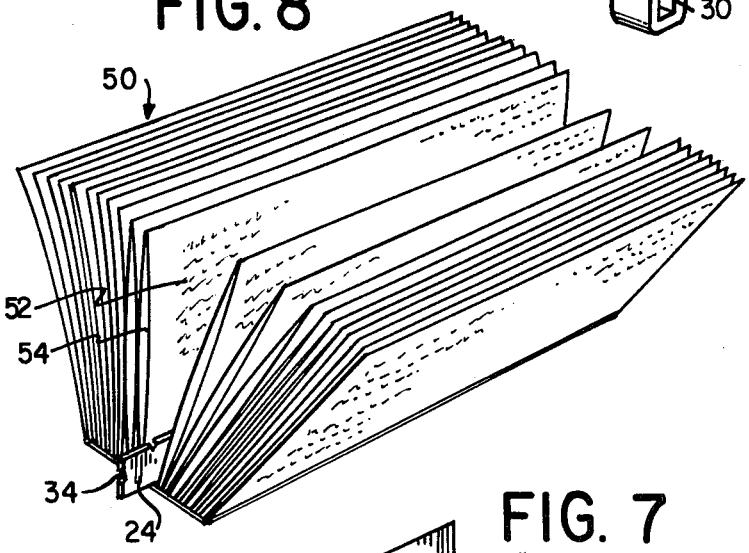
FIG. 8 is a perspective view of the sheets illustrated in FIG. 7 after they have been bound in accordance with the present invention.
Figure 7:
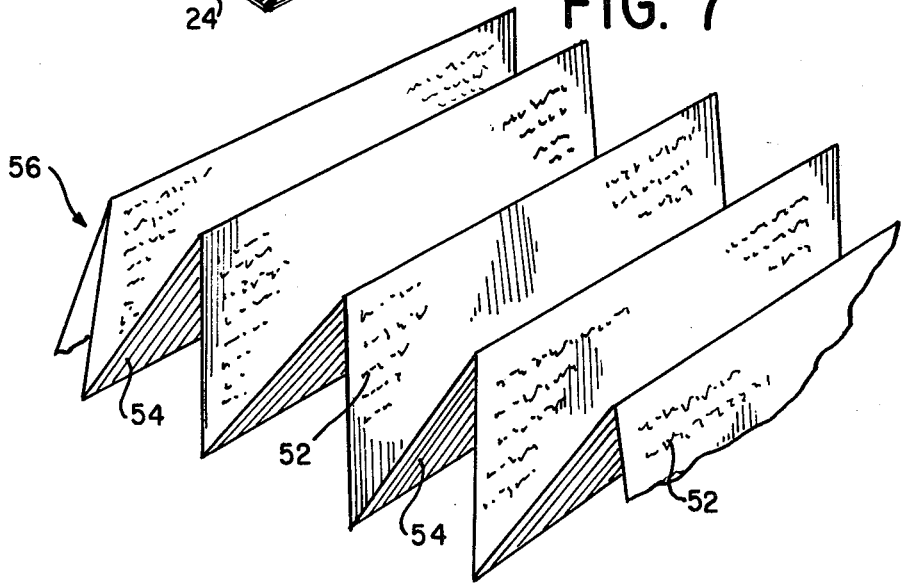
FIG. 7 is a perspective view of the folded output sheets of conventional data processing equipment which may be suitably bound in accordance with the present invention.

Binding of the stack of sheets illustrated in FIG. 8 on one of its sides results in exposing the printed side of the continuous sheet. Such an arrangement is shown in FIG. 7 in which the continuous folded series of pages illustrated in FIG. 8 has been bound into a book 50 in accordance with the invention. The sheets are only printed on one side 52 while the reverse side 54 has not been printed.

While an illustrative embodiment of the present invention has been disclosed, it is understood that various modifications in the shape, form and size of the parts will be obvious to those of ordinary skill in the art. Such modifications are within the spirit and scope of the invention as limited only by the appended claims.

I claim:

1. A bound volume of sheets comprising:

(a) a first stack of sheets disposed over each other, each of said sheets having an edge in alignment with corresponding edges on the other sheets of said first stack, said edges forming a first substantially continuous surface;

(b) bar means of a length longer than said edges having two ends disposed adjacent said first stack and having a surface in alignment with and substantially flush with said first substantially continuous surface, the ends of said bar means extending beyond two opposite ends of said first substantially continuous surface;

(c) a second stack of sheets disposed adjacent said bar, each of said sheets having an edge in alignment with corresponding edges on the other sheets of said second stack, said edges forming a second substantially continuous surface, said first and second substantially continuous surfaces and the aligned surface of said bar means together forming a single substantially continuous surface and the ends of said bar means forming supports for engagement by an engaging structure in a storage device;

(d) said stacks of sheets having their aligned edges and said aligned surface of said bar being adhesively bound into a unit along said single continuous surface by a layer of adhesive therealong; and (e) said layer of adhesive serving as the sole means for securing said bar and said stacks of sheets into a unit, (f) a pair of caps adapted to mate with and be secured to said ends and to support said bound volume in a support device, wherein each of said caps comprising:

(1) a body defining a channel which extends in the same direction as said bar means and is adapted to engage the end of said bar means;

(2) engagement arm means secured to said body and extending in said same direction along the length of said bar means and positioned, configured and dimensioned to engage said single substantially continuous surface when said cap is slidably advanced onto said end; and (3) Means to engage a bar which extends in a second direction substantially transverse to the direction in which said bar means extends.

2. A bound volume as in claim 1, wherein said last means to engage a bar comprising a depression.

3. A bound volume as in claim 2, further comprising:

(a) slidable engagement means secured to said body and extending along said same direction and positioned, configured and dimensioned to allow said slidable engagement means to be placed into engagement with a mating slidable engagement means when said cap is advanced into said mating slidable engagement means by movement in the direction in which said bar means extends.

4. A cap for a bound volume which includes two support ends which extend from the binding of said bound volume, said cap comprising:

(a) a body defining a channel which extends in a first direction and is adapted to engage a support end;

(b) engagement arm means secured to said body and extending in said first direction and positioned, configured and dimensioned to engage said binding when said cap is slidably advanced onto said support end;

(c) depression means configured, dimensioned and positioned to engage a bar extending in a second direction substantially transverse said first direction; and (d) slidable engagement means secured to said body and extending along said first direction and positioned, configured and dimensioned to allow said slidable engagement means to be placed into engagement with a mating slidable engagement means when said cap is advanced into said mating slidable engagement means by movement in the direction in which said bar means extends.

* * * * *